US010935248B2

(12) United States Patent
Hensley

(10) Patent No.: US 10,935,248 B2
(45) Date of Patent: Mar. 2, 2021

(54) METHOD OF OPERATING AN IGNITION ELEMENT OF A GAS BURNER

(71) Applicant: Haier US Appliance Solutions, Inc., Wilmington, DE (US)

(72) Inventor: Amelia Lear Hensley, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 84 days.

(21) Appl. No.: 16/288,229

(22) Filed: Feb. 28, 2019

(65) Prior Publication Data

US 2020/0278115 A1 Sep. 3, 2020

(51) Int. Cl.

| | |
|---|---|
| ***F24C 3/12*** | (2006.01) |
| ***F24C 3/10*** | (2006.01) |
| *F23N 5/20* | (2006.01) |
| *F23N 5/24* | (2006.01) |

(52) U.S. Cl.

CPC ..... *F24C 3/122* (2013.01); *F24C 3/103* (2013.01); *F23N 5/20* (2013.01); *F23N 5/24* (2013.01)

(58) Field of Classification Search

CPC .. F24C 3/103; F24C 3/122; F23N 5/20; F23N 5/203; F23N 5/24

See application file for complete search history.

(56) References Cited

U.S. PATENT DOCUMENTS

| | | | | |
|---|---|---|---|---|
| 2,954,080 | A * | 9/1960 | Prouty | F23N 5/20 431/70 |
| 4,019,853 | A * | 4/1977 | Sears | F23N 5/20 431/67 |
| 4,086,048 | A * | 4/1978 | Carlson | F23N 5/203 431/46 |
| 4,111,639 | A * | 9/1978 | Matthews | F23N 5/123 431/25 |
| 4,190,414 | A * | 2/1980 | Elmy | F23N 5/20 431/6 |
| 4,249,884 | A * | 2/1981 | Cade | F23N 5/203 431/31 |
| 4,622,005 | A * | 11/1986 | Kuroda | F23N 5/123 431/78 |
| 6,666,676 | B2 | 12/2003 | Rodriguez-Rodriguez et al. | |
| 8,807,987 | B2 * | 8/2014 | Lehman | F23N 3/04 431/6 |

(Continued)

FOREIGN PATENT DOCUMENTS

| | | | |
|---|---|---|---|
| CN | 101514821 | A | 8/2009 |
| JP | 2002238776 | A | 8/2002 |

*Primary Examiner* — David J Laux
*Assistant Examiner* — Nikhil P Mashruwala
(74) *Attorney, Agent, or Firm* — Dority & Manning, P.A.

(57) ABSTRACT

An oven appliance and a method of operating the same are provided. The oven appliance includes a heating element such as a gas burner that is provided with a flow of fuel and an ignition element for igniting the flow of fuel. The method includes activating the ignition element by closing an ignitor relay and determining an adjusted flame time based on a target flame time and an ignition delay. The ignition element is deactivated when the adjusted flame time has passed since the activation of the ignition element. The method may further include compensating for the extinction delay of the gas burner to achieve the desired heating time.

20 Claims, 4 Drawing Sheets

(56) References Cited

U.S. PATENT DOCUMENTS

| | | | | |
|---|---|---|---|---|
| 9,022,778 | B2 * | 5/2015 | Schlachter | F23N 5/242 431/73 |
| 9,784,449 | B2 * | 10/2017 | Margolin | G08B 17/125 |
| 10,151,493 | B2 * | 12/2018 | French | F16K 31/0675 |
| 10,208,954 | B2 * | 2/2019 | Chian | F23N 5/242 |
| 2012/0288806 | A1 * | 11/2012 | Racaj | F23N 5/123 431/18 |
| 2014/0186779 | A1 | 7/2014 | Chodacki et al. | |
| 2015/0047627 | A1 * | 2/2015 | Thielvoldt | F23N 1/002 126/503 |
| 2018/0080657 | A1 * | 3/2018 | Billman | F24C 3/122 |
| 2019/0249871 | A1 * | 8/2019 | Chian | F23N 5/203 |
| 2020/0063973 | A1 * | 2/2020 | Hensley | F24C 7/082 |
| 2020/0217504 | A1 * | 7/2020 | Hensley | F16K 11/105 |

* cited by examiner

METHOD OF OPERATING AN IGNITION ELEMENT OF A GAS BURNER

FIELD OF THE INVENTION

The present subject matter relates generally to oven appliances, and more particularly, to methods of igniting a gas burner of an oven appliance.

BACKGROUND OF THE INVENTION

Conventional residential and commercial oven appliances generally include a cabinet that includes a cooking chamber for receipt of food items for cooking. Multiple gas heating elements are positioned within the cooking chamber to provide heat to food items located therein. The gas heating elements can include, for example, a bake heating assembly positioned at a bottom of the cooking chamber and/or a separate broiler heating assembly positioned at a top of the cooking chamber. In addition, oven appliances often include one or more gas burners, e.g., positioned at a cooktop surface for use in heating or cooking an object, such as a cooking utensil and its contents. These gas heating elements and gas burners typically combust a mixture of gaseous fuel and air to generate heat for cooking.

Conventional gas burners typically do not provide heat output immediately upon ignition. Instead, there is a delay from the time heat is requested until heat is output from the burner due to the time required for ignition. Hot surface igniters are commonly used in these systems and can require 30 to 60 seconds to sufficiently heat up before the fuel regulating device or safety valve opens to allow gas to flow to the burner. Spark igniters, which are less commonly used due to the audible output of the system, still have a delay, though much smaller, before the valve opens to allow gas to flow. Once gas flows, the gas ignites, and finally heat is output from the burner; delayed from when heat was initially requested. The delay will differ depending on supply voltage, assembly tolerances, part variation, and ambient conditions. In addition, after the ignitor is deactivated, there may be an additional time until the burner extinguishes. However, conventional control methods dictate fixed ON times for burner relays without compensating for ignition and/or extinction delays, thus yielding differences in actual heat output.

Accordingly, an oven appliance and methods for operating the same for precise heat output would be useful. More particularly, a method of operating an ignition element of a gas burner to compensate for ignition and extinction delays would be particularly beneficial.

BRIEF DESCRIPTION OF THE INVENTION

Aspects and advantages of the invention will be set forth in part in the following description, or may be apparent from the description, or may be learned through practice of the invention.

In a first example embodiment, an oven appliance is provided including a cabinet, a cooking chamber positioned within the cabinet, and a heating element for generating thermal energy by burning a flow of fuel. A fuel regulating device is operably coupled to the heating element for selectively providing the flow of fuel to the heating element and an ignition element is operably coupled to the heating element for igniting the flow of fuel. A controller is operably coupled to the ignition element for activating the ignition element and starting a timer, obtaining a target flame time, obtaining an ignition delay of the ignition element, determining an adjusted flame time based at least in part on the ignition delay, and deactivating the ignition element when the timer reaches the adjusted flame time.

In a second example embodiment, a method of operating an ignition element to ignite a flow of fuel provided through a flow regulating device to a heating element of an oven appliance is provided. The method includes activating the ignition element and starting a timer, obtaining a target flame time, obtaining an ignition delay of the ignition element, determining an adjusted flame time based at least in part on the ignition delay, and deactivating the ignition element when the timer reaches the adjusted flame time.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
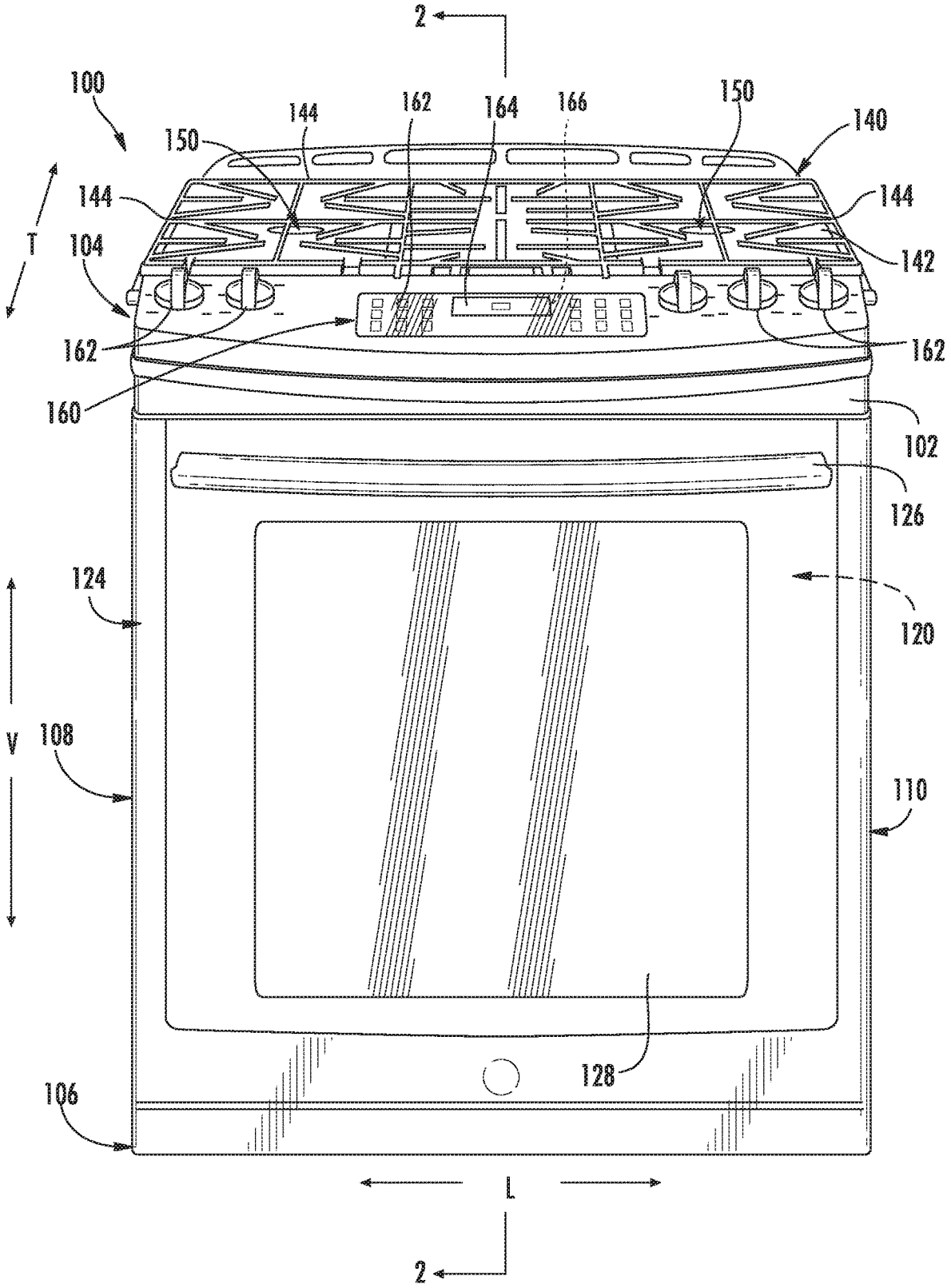
FIG. 1 is a front, perspective view of an oven appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, perspective view of an oven appliance 100 as may be employed with the present subject matter. Oven appliance 100 generally defines a vertical direction V, a lateral direction L, and a transverse direction T, each of which is mutually perpendicular, such that an orthogonal coordinate system is generally defined. As illustrated, oven appliance 100 includes an insulated cabinet 102. Cabinet 102 of oven appliance 100 extends between a top 104 and a bottom 106 along the vertical direction V, between a first side 108 (left side when viewed from front) and a second side 110 (right side when viewed from front) along the lateral direction L, and between a front 112 and a rear 114 along the transverse direction T.

Within cabinet 102 is a single cooking chamber 120 which is configured for the receipt of one or more food items to be cooked. However, it should be appreciated that oven appliance 100 is provided by way of example only, and aspects of the present subject matter may be used in any suitable cooking appliance, such as a double oven range appliance. Thus, the example embodiment shown in FIG. 1 is not intended to limit the present subject matter to any particular cooking chamber configuration or arrangement.

Oven appliance 100 includes a door 124 rotatably attached to cabinet 102 in order to permit selective access to cooking chamber 120. Handle 126 is mounted to door 124 to assist a user with opening and closing door 124 in order to access cooking chamber 120. As an example, a user can pull on handle 126 mounted to door 124 to open or close door 124 and access cooking chamber 120. One or more transparent viewing windows 128 (FIG. 1) may be defined within door 124 to provide for viewing the contents of cooking chamber 120 when door 124 is closed and also assist with insulating cooking chamber 120.

Figure 2:
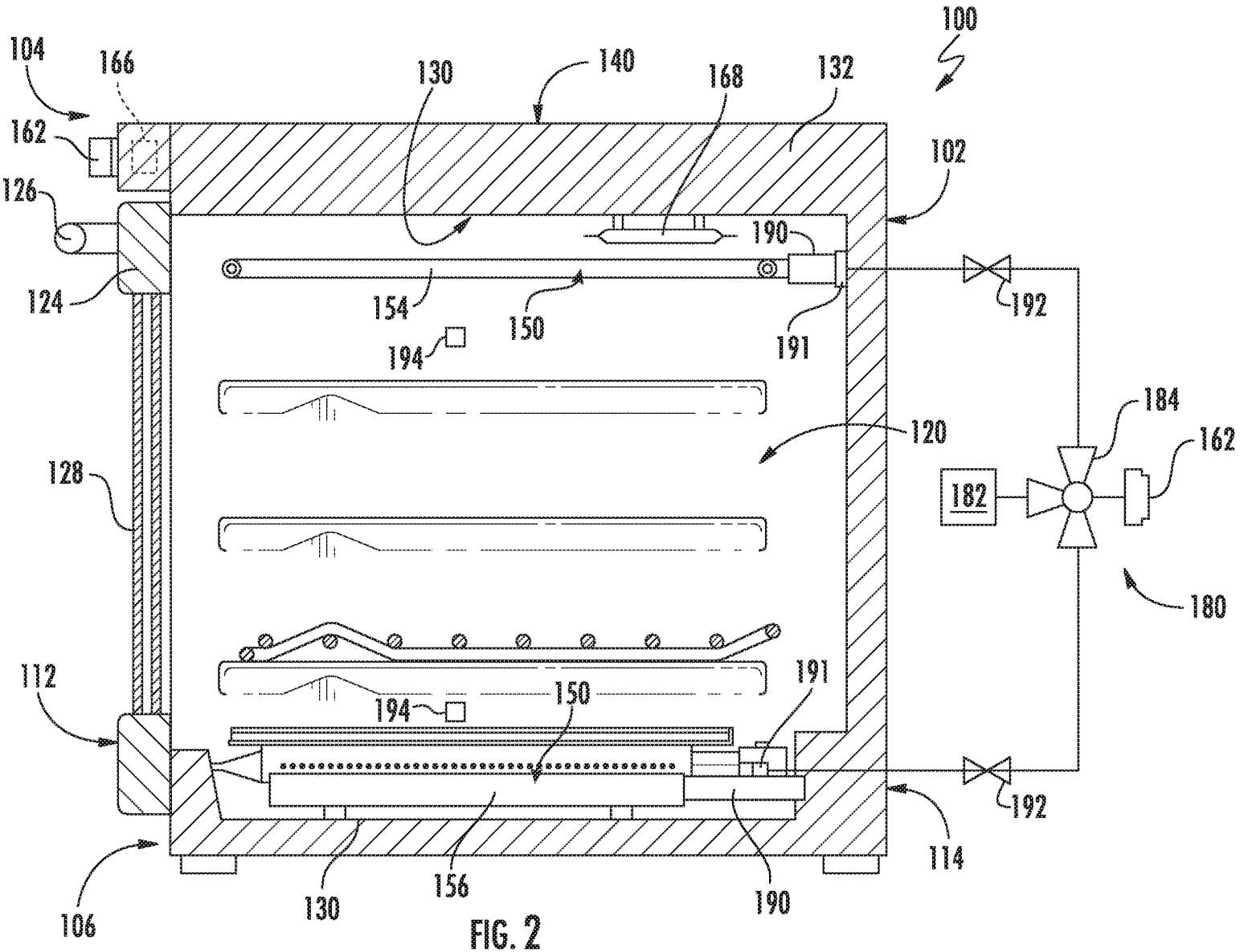
FIG. 2 is a close-up cross sectional view of the exemplary oven appliance of FIG. 1, taken along Line 2-2 in FIG. 1.

In general, cooking chamber 120 is defined by a plurality of chamber walls 130 (FIG. 2). Specifically, cooking chamber 120 may be defined by a top wall, a rear wall, a bottom wall, and two sidewalls 130. These chamber walls 130 may be joined together to define an opening through which a user may selectively access cooking chamber 120 by opening door 124. In order to insulate cooking chamber 120, oven appliance 100 includes an insulating gap defined between the chamber walls 130 and cabinet 102. According to an exemplary embodiment, the insulation gap is filled with an insulating material 132, such as insulating foam or fiberglass, for insulating cooking chamber 120.

Oven appliance 100 also includes a cooktop 140. Cooktop 140 is positioned at or adjacent top 104 of cabinet 102 such that it is positioned above cooking chamber 120. Specifically, cooktop 140 includes a top panel 142 positioned proximate top 104 of cabinet 102. By way of example, top panel 142 may be constructed of glass, ceramics, enameled steel, and combinations thereof. One or more grates 144 are supported on a top surface of top panel 142 for supporting cooking utensils, such as pots or pans, during a cooking process.

Oven appliance may further include one or more heating elements (identified generally by reference numeral 150) for selectively heating cooking utensils positioned on grates 144 or food items positioned within cooking chamber 120. For example, referring to FIG. 1, heating elements 150 may be gas burners 150. Specifically, a plurality of gas burners 150 are mounted within or on top of top panel 142 such that grates 144 support cooking utensils over gas burners 150 while gas burners 150 provide thermal energy to cooking utensils positioned thereon, e.g., to heat food and/or cooking liquids (e.g., oil, water, etc.). Gas burners 150 can be configured in various sizes so as to provide e.g., for the receipt of cooking utensils (i.e., pots, pans, etc.) of various sizes and configurations and to provide different heat inputs for such cooking utensils. According to alternative embodiments, oven appliance 100 may have other cooktop configurations or burner elements.

In addition, heating elements 150 may be positioned within or may otherwise be in thermal communication with cooking chamber 120 for regulating the temperature within cooking chamber 120. Specifically, an upper gas heating element 154 (also referred to as a broil heating element or gas burner) may be positioned in cabinet 102, e.g., at a top portion of cooking chamber 120, and a lower gas heating element 156 (also referred to as a bake heating element or gas burner) may be positioned at a bottom portion of cooking chamber 120. Upper gas heating element 154 and lower gas heating element 156 may be used independently or simultaneously to heat cooking chamber 120, perform a baking or broil operation, perform a cleaning cycle, etc. The size and heat output of gas heating elements 154, 156 can be selected based on the, e.g., the size of oven appliance 100 or the desired heat output. Oven appliance 100 may include any other suitable number, type, and configuration of heating elements 150 within cabinet 102 and/or on cooktop 140. For example, oven appliance 100 may further include electric heating elements, induction heating elements, or any other suitable heat generating device.

A user interface panel 160 is located within convenient reach of a user of the oven appliance 100. For this example embodiment, user interface panel 160 includes knobs 162 that are each associated with one of heating elements 150. In this manner, knobs 162 allow the user to activate each heating element 150 and determine the amount of heat input provided by each heating element 150 to a cooking food items within cooking chamber 120 or on cooktop 140. Although shown with knobs 162, it should be understood that knobs 162 and the configuration of oven appliance 100 shown in FIG. 1 is provided by way of example only. More specifically, user interface panel 160 may include various input components, such as one or more of a variety of touch-type controls, electrical, mechanical or electro-mechanical input devices including rotary dials, push buttons, and touch pads. User interface panel 160 may also be provided with one or more graphical display devices or display components 164, such as a digital or analog display device designed to provide operational feedback or other information to the user such as e.g., whether a particular heating element 150 is activated and/or the rate at which the heating element 150 is set.

Generally, oven appliance 100 may include a controller 166 in operative communication with user interface panel 160. User interface panel 160 of oven appliance 100 may be in communication with controller 166 via, for example, one or more signal lines or shared communication busses, and signals generated in controller 166 operate oven appliance 100 in response to user input via user input devices 136. Input/Output ("I/O") signals may be routed between controller 166 and various operational components of oven appliance 100 such that operation of oven appliance 100 can be regulated by controller 166. In addition, controller 166 may also be communication with one or more sensors, such as temperature sensor 168 (FIG. 2), which may be used to measure temperature inside cooking chamber 120 and provide such measurements to the controller 166. Although temperature sensor 168 is illustrated at a top and rear of cooking chamber 120, it should be appreciated that other sensor types, positions, and configurations may be used according to alternative embodiments.

Controller 166 is a "processing device" or "controller" and may be embodied as described herein. Controller 166 may include a memory and one or more microprocessors, microcontrollers, application-specific integrated circuits (ASICS), CPUs or the like, such as general or special purpose microprocessors operable to execute programming instructions or micro-control code associated with operation of oven appliance 100, and controller 166 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Although aspects of the present subject matter are described herein in the context of a single oven appliance, it should be appreciated that oven appliance 100 is provided by way of example only. Other oven or range appliances having different configurations, different appearances, and/or different features may also be utilized with the present subject matter, e.g., double ovens, standalone cooktops, etc. Moreover, aspects of the present subject matter may be used in any other consumer or commercial appliance where it is desirable to compensate for the ignition or extinction delay of a gas burner during a heating operation.

Referring now specifically to FIG. 2, a schematic view of upper gas heating element 154 and lower gas heating element 156 within a cooking chamber 120 and a fuel supply system 180 will be described. In general, fuel supply system 180 is configured for selectively supplying gaseous fuel such as propane, natural gas, liquefied petroleum (LP), butane, or any other suitable fuel to heating elements 150 to regulate the amount of heat generated. In particular, fuel supply system 180 includes pressurized gaseous fuel source 182, such as a natural gas supply line, a propane tank, etc. In this manner, a flow of supply fuel, such as gaseous fuel (e.g., natural gas or propane), is flowable from the pressurized gaseous fuel source 182 to heating elements 150.

Fuel supply system 180 further includes a control valve or fuel regulating device 184 operably coupling gaseous fuel source 182 to heating elements 150. Specifically, as illustrated, fuel regulating device 184 is a three-way, solenoid-controlled valve or bimetal valve for selectively directing a metered amount of fuel to upper gas heating element 154 and lower gas heating element 156. More specifically, according to an exemplary embodiment, control knob 162 (or user interface panel 160 more generally) may be operably coupled to flow regulating device 184 for regulating the flow of supply fuel. In this regard, a user may rotate control knob 162 to adjust the position of flow regulating device 184 and the flow of supply fuel from gaseous fuel source 182 to both upper gas heating element 154 and lower gas heating element 156.

Referring still to FIG. 2, oven appliance 100 may further include an ignition element 190 which is operably coupled to each gas burner 150 for igniting the flow of fuel as it passes into gas burner 150. Specifically, according to the illustrated embodiment, ignition element 190 is a hot surface igniter, e.g., such as a silicon carbide, silicon nitride, or any other suitable hot surface igniter for use with a gas burner. However, it should be appreciated that according to alternative embodiments, the ignition element 190 may be any other suitable ignition device, such as a spark electrode, a pilot light, etc. As shown, ignition element 190 is positioned proximate a rear of each of upper gas heating element 154 and lower gas heating element 156, e.g., at the entrance where the flow of fuel was provided into the respective heating element 154, 156.

In general, ignition elements 190 may be activated and deactivated by controller 166 to facilitate the igniting and extinguishing processes, respectively, of a gas burner 150. Specifically, for example, controller 166 may regulate a position of an igniter relay 191 (FIG. 2) which may be closed to energize ignition element 190, thereby causing ignition element 190 to heat up and ignite the flow of fuel. By contrast, controller 166 may open the igniter relay 191 to permit ignition element 190 cool below temperature at which the flow of fuel may be stopped (e.g., by safety valve 192 described below) and the flame may be extinguished.

Notably, as explained briefly above, the flow of fuel may not be instantaneously ignited when the igniter relay is closed or ignition element 190 is otherwise energized and begins to heat up. For example, the flow of fuel may typically ignite when ignition element 190 reaches a predetermined threshold temperature which may be known as sufficient for igniting the flow of fuel. In order to prevent the flow of fuel into gas burners 150 prior to ignition element 190 reaching the suitable predetermined threshold temperature, a fuel regulating device may be fluidly coupled to a fuel supply line and communicatively coupled to ignition element 190 (e.g., indirectly through controller 166) for preventing the flow of fuel until such temperature is reached.

Specifically, as shown in FIG. 2, the fuel regulating device may be a safety valve 192 that is operably coupled to a supply line between the fuel regulating device 184 and each gas burner 150. Safety valve 192 may remain in the closed position until ignition element 190 reaches or exceeds the predetermined threshold temperature for combustion. Once ignition element 190 has reached the threshold temperature, safety valve 192 may open to permit the flow of fuel from fuel source 182. Similarly, when ignition element 190 drops below the threshold temperature after a heating cycle, safety valve 192 may close again to prevent the flow of fuel.

Although safety valve 192 is illustrated as being a dedicated valve separate from fuel regulating device 184, it should be appreciated that according to alternative embodiments, a single fuel regulating device may be used to control the flows of fuel to each burner and may include redundant safety valve features which operate similar to safety valve 192. Other fuel regulating systems may be used to implement aspects of the present subject matter while remaining within the scope of the present invention.

Notably, safety valve 192 may be operably coupled to ignition element 190 in any manner suitable for providing an indication as to the temperature or the state of operation of ignition element 190. For example, according to one embodiment, the temperature of ignition element 190 is approximated based on an electrical resistance of ignition element 190. In this regard, controller 166 may monitor the electrical resistance of ignition element 190 and may provide a command to open safety valve 192 when the electrical resistance drops below a certain threshold, e.g., indicating a suitable ignition temperature.

According to exemplary embodiments of the present subject matter, oven appliance 100 may include a flame detection system 194 which is generally configured for determining presence of flame generated by one or more gas burners 150. Specifically, as shown in FIG. 2, appliance 100 may include two flame detection systems 194 for detecting flames at the upper gas heating element 154 and lower gas heating element 156, respectively. It should be appreciated that flame detection system 194 may utilize any known flame detection methods, such as flame rectification, temperature measurements, optical measurements (e.g., infrared, ultraviolet, etc.), or other suitable devices for detecting the presence of a flame. According to exemplary embodiments, flame detection system 194 may be operably coupled to controller 166, e.g., for providing feedback control regarding flame presence, for adjusting ignition and extinction delay times, etc.

Now that the construction and configuration of oven appliance 100, fuel supply system 180, and ignition element 190 have been described according to exemplary embodiments of the present subject matter, an exemplary method 200 for operating oven appliance 100 will be described according to an exemplary embodiment of the present subject matter. Method 200 can be used to operate oven appliance 100, fuel supply system 180, and ignition element 190, or may be used to operate any other suitable oven appliances. In this regard, for example, controller 166 may be configured for implementing some or all steps of method 200. Further, it should be appreciated that the exemplary method 200 is discussed herein only to describe exemplary aspects of the present subject matter, and is not intended to be limiting.

Figure 3:
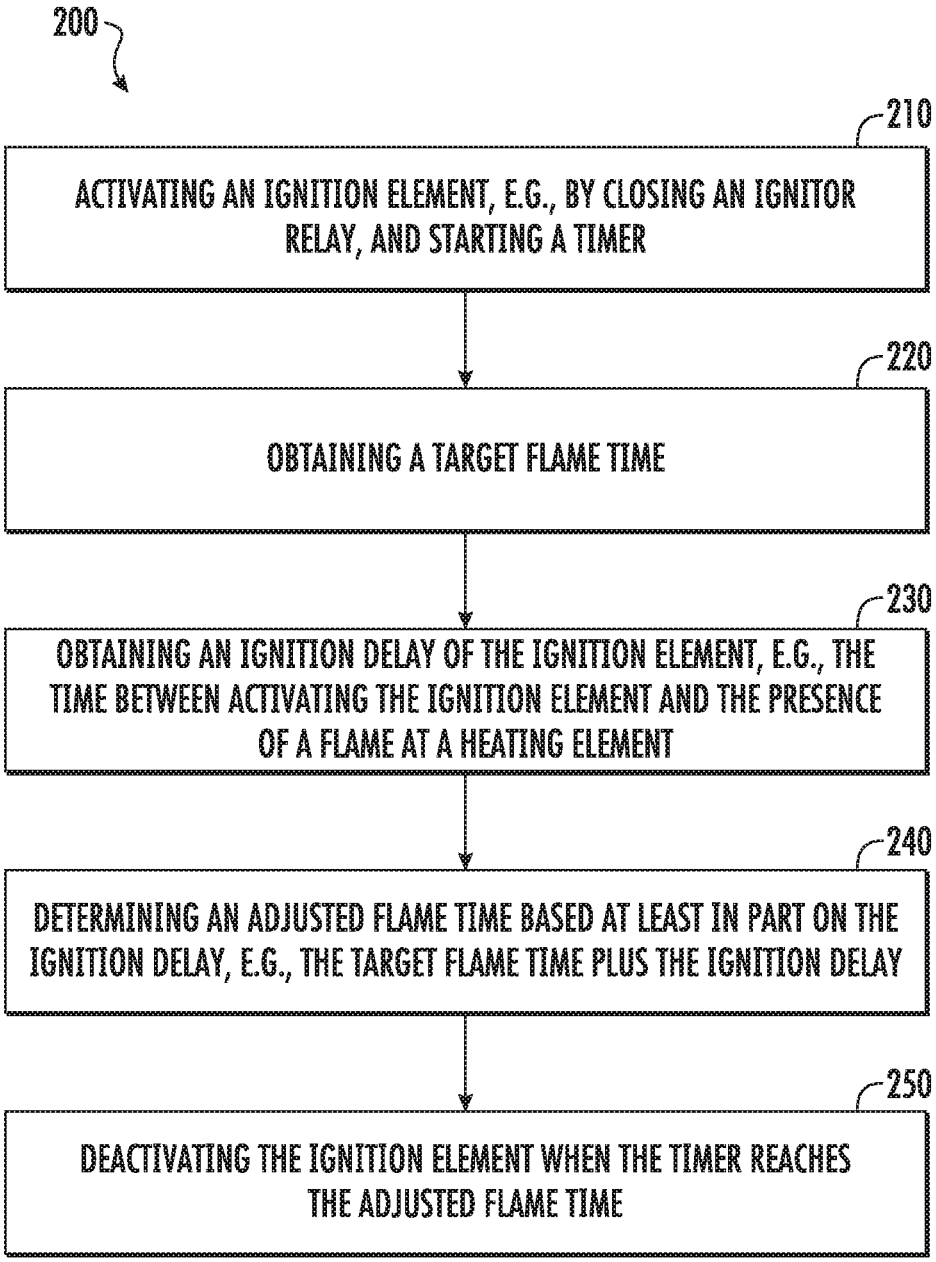
FIG. 3 is a method of operating an oven appliance according to an exemplary embodiment of the present subject matter.
Figure 4:
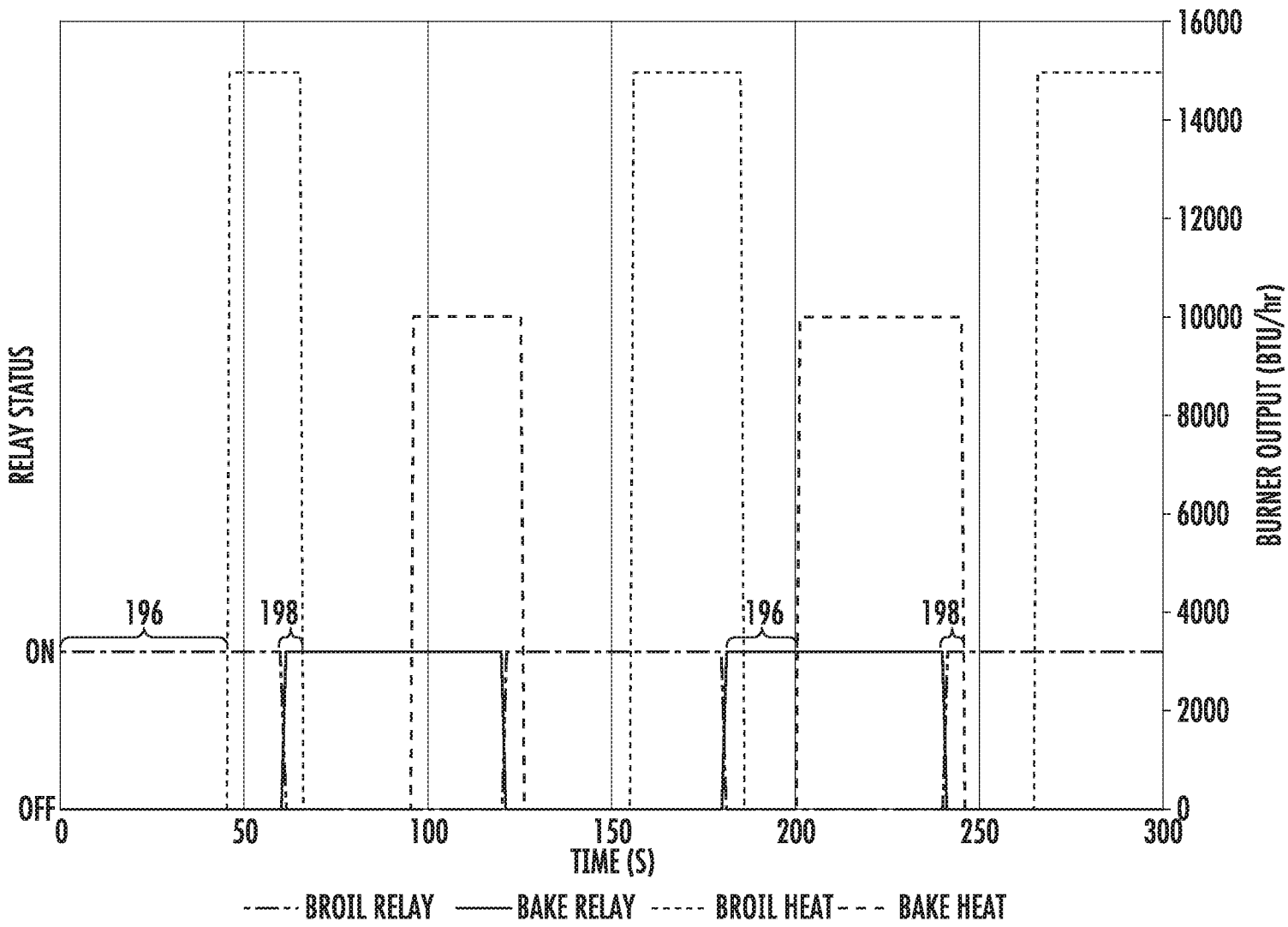
FIG. 4 is plot illustrating the power output of bake and broil gas heating elements of the exemplary oven appliance of FIG. 1 according to an exemplary embodiment of the present subject matter.

Referring now to FIG. 3, method 200 includes, at step 210, activating an ignition element of an oven appliance and starting a timer. Specifically, continuing the example from above, controller 166 may be operably coupled to ignition element 190 and may close an igniter relay to energize and begin the heating of ignition element 190, e.g., in response to user manipulation of one or more control knobs 162. In addition, step 220 may include obtaining a target flame time for the specific burner being ignited. For example, a particular cooking cycle of oven appliance 100 may include alternating the bake and broil elements ON and OFF in 60 second increments. For example, such as cooking cycle is illustrated according to an exemplary embodiment in FIG. 4. Thus, the target flame time is alternating each burner every 60 seconds.

Notably, as explained above and shown in FIG. 4, oven appliance 100 can experience an ignition delay (e.g., as indicated by reference numeral 196) and an extinction delay (e.g., as indicated by reference numeral 198). Method 200 may account for one or both of these delays to ensure that the actual heating time is substantially equivalent to the target flame time. For example, step 230 may include obtaining an ignition delay of the ignition element. For example, the ignition delay may be measured as the time between activating ignition element and the presence of the flame at the heating element. It should be appreciated that as used herein, terms of approximation, such as "approximately," "substantially," or "about," refer to being within a ten percent margin of error.

Step 240 may include determining an adjusted flame time based at least in part on the ignition delay. For example, according to an exemplary embodiment, the adjusted flame time may be equivalent to the target flame time plus the ignition delay. Thus, for example, if 60 seconds of heat (e.g. flame at gas burner 150) is desired, but the ignition element 190 experiences a 20 second ignition delay, the adjusted flame time may be 80 seconds such that the actual amount of time gas burner 150 is ignited is 60 seconds.

Step 250 may include deactivating the ignition element when the timer reaches the adjusted flame time. In this manner, ignition element 190 is not turned off until gas burner 150 has been generating a flame and heating oven chamber 120 for the target flame time. Although the example above factors in only ignition delay in controlling the ignition element 190, it should be appreciated that other delays such as extinction delay may also be factored into the adjusted flame time. For example, according to another embodiment, method 200 may further include determining an extinction time, which may be generally measured as the amount of time after turning off the ignition element 190 that the flame is actually extinguished. Moreover, according to such an embodiment, step 240 may include determining the adjusted flame time based at least in part on both the ignition delay and extinction delay. Specifically, the adjusted flame time may be equal to the target flame time (e.g., 60 seconds) plus the ignition delay (e.g., 20 seconds) minus the extinction time (e.g., 5 seconds), resulting in an adjusted flame time of approximately 75 seconds.

Although the example above refers to implementing method 200 on a single gas burner 150, it should be appreciated that method 200 may be used to control ignition elements of multiple gas burners within an oven appliance 100. For example, ignition element 190 may be separately controlled for upper gas heating element 154 and lower gas heating element 156 of oven appliance 100. In addition, the ignition delay in the extinction delay may be determined or known by controller 166 for each ignition element 190 in oven appliance. In addition, according to an exemplary embodiment, flame detection system 194 may be used to update the ignition and extinction delays for use in controlling subsequent burner operation.

FIG. 3 depicts an exemplary control method having steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of the methods are explained using oven appliance 100, fuel supply system 180, and ignition element 190 as an example, it should be appreciated that these methods may be applied to monitoring the operation of any suitable oven appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a cabinet;

a cooking chamber positioned within the cabinet;

a heating element for generating thermal energy by burning a flow of fuel;

a fuel regulating device operably coupled to the heating element for selectively providing the flow of fuel to the heating element;

an ignition element operably coupled to the heating element for igniting the flow of fuel; and a controller operably coupled to the ignition element, the controller being configured for:

activating the ignition element and starting a timer;

obtaining a target flame time;

obtaining an ignition delay of the ignition element;

determining an adjusted flame time based at least in part on the ignition delay; and deactivating the ignition element when the timer reaches the adjusted flame time.

2. The oven appliance of claim 1, wherein activating the ignition element comprises closing an ignitor relay to energize the ignition element.

3. The oven appliance of claim 1, wherein the ignition element is a hot surface igniter.

4. The oven appliance of claim 1, wherein the ignition delay is the time between activating the ignition element and the presence of a flame at the heating element.

5. The oven appliance of claim 1, wherein the fuel regulating device is a safety valve that provides the flow of fuel when a temperature of the ignition element exceeds a predetermined threshold temperature.

6. The oven appliance of claim 5, wherein the temperature of the ignition element is approximated based on an electrical resistance of the ignition element.

7. The oven appliance of claim 1, wherein the adjusted flame time is equal to the target flame time plus the ignition delay.

8. The oven appliance of claim 1, wherein the controller is further configured for:

determining an extinction time, wherein the adjusted flame time is based at least in part on the extinction time.

9. The oven appliance of claim 8, wherein the adjusted flame time is equal to the target flame time plus the ignition delay minus the extinction time.

10. The oven appliance of claim 1, wherein the ignition delay is determined using a flame detection system.

11. The oven appliance of claim 10, wherein the flame detection system uses flame rectification, temperature measurements, or optical measurements.

12. The oven appliance of claim 1, wherein the controller is configured for determining the adjusted flame time for at least two separate heating elements within the oven appliance.

13. A method of operating an ignition element to ignite a flow of fuel provided through a flow regulating device to a heating element of an oven appliance, the method comprising:

activating the ignition element and starting a timer;

obtaining a target flame time;

obtaining an ignition delay of the ignition element;

determining an adjusted flame time based at least in part on the ignition delay; and deactivating the ignition element when the timer reaches the adjusted flame time.

14. The method of claim 13, wherein activating the ignition element comprises closing an ignitor relay to energize the ignition element.

15. The method of claim 13, wherein the ignition element is a hot surface igniter.

16. The method of claim 13, wherein the ignition delay is the time between activating the ignition element and the presence of a flame at the heating element.

17. The method of claim 13, wherein the adjusted flame time is equal to the target flame time plus the ignition delay.

18. The method of claim 13, further comprising:

determining an extinction time, wherein the adjusted flame time is based at least in part on the extinction time.

19. The method of claim 18, wherein the adjusted flame time is equal to the target flame time plus the ignition delay minus the extinction time.

20. The method of claim 13, further comprising:

determining the adjusted flame time for at least two separate heating elements within the oven appliance.

* * * * *